United States Patent [19]

Johnston et al.

[11] 4,227,058

[45] Oct. 7, 1980

[54] TURN-START PUSH-STOP SWITCH OPERATOR

[75] Inventors: Robert J. Johnston, Beaver Falls; Stephen G. Layciak, Beaver; Dominic Colista, Ambridge, all of Pa.

[73] Assignee: Westinghouse Electric Corp., Pittsburgh, Pa.

[21] Appl. No.: 25,178

[22] Filed: Mar. 29, 1979

[51] Int. Cl.[2] ..... H01H 9/20; H01H 3/08

[52] U.S. Cl. ..... 200/153 J; 200/153 L; 200/318; 200/325; 200/336; 200/155 R

[58] Field of Search ..... 200/318, 321, 322, 323, 200/324, 325, 327, 328, 336, 153 J, 153 L, 155 R, 156, 64

[56] References Cited

U.S. PATENT DOCUMENTS

| | | | |
|---|---|---|---|
| 2,498,614 | 2/1950 | Tregoning | 200/153 L |
| 2,763,753 | 9/1956 | Hasselbaum | 200/336 |
| 3,142,187 | 7/1964 | Kane et al. | 200/153 L |
| 3,770,926 | 11/1973 | Wanner | 200/153 L |
| 3,919,506 | 11/1975 | Kellogg | 200/153 L |

FOREIGN PATENT DOCUMENTS

| | | | |
|---|---|---|---|
| 460124 | 9/1968 | Switzerland | 200/153 J |

*Primary Examiner*—John W. Shepperd
*Attorney, Agent, or Firm*—L. P. Johns

[57] ABSTRACT

A turn-push electric switch operator characterized by a tubular housing having a switch operator therein with a detent extending therefrom, a detent cam having a camming surface inclined at an angle to the axis of the housing with a detent retaining notch, and a manual handle operable between first and second positions and having a camming surface for returning the handle from one position to the other.

5 Claims, 4 Drawing Figures

FIG.3
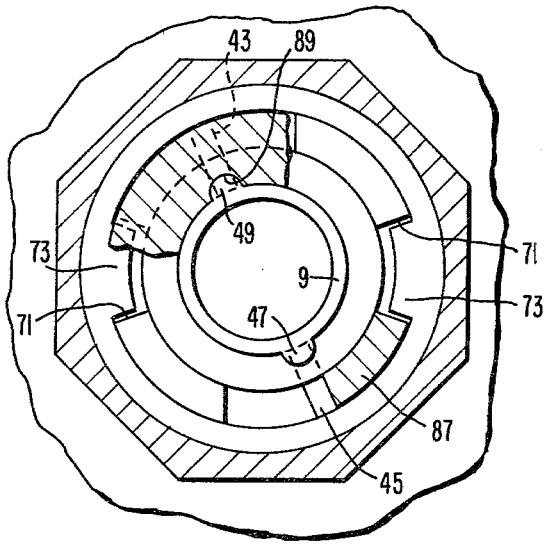
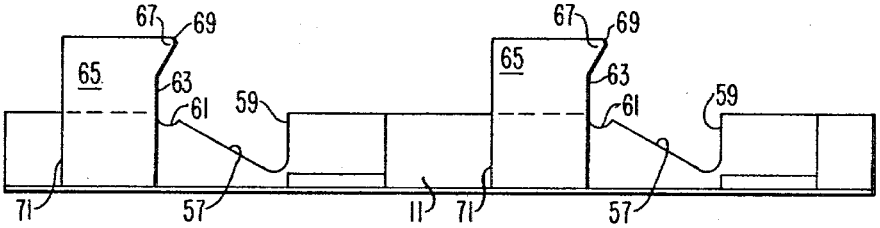
FIG. 4

TURN-START PUSH-STOP SWITCH OPERATOR

CROSS REFERENCE TO RELATED APPLICATIONS

This application is related to the copending applications of Robert J. Johnston et al., Ser. No. 29,515, filed Apr. 12, 1979; Robert J. Johnston et al., Ser. No. 45,450, filed June 4, 1979; Robert J. Johnston et al., Ser. No. 45,448, filed June 4, 1979; and Robert J. Johnston et al., Ser. No. 45,449, filed June 4, 1979.

BACKGROUND OF THE INVENTION

1. Field of the Invention:

This invention relates to a switch operator and, more particularly, it pertains to a push-turn switch operator for moving the switch between two operating positions.

2. Description of the Prior Art:

Ordinarily electric switches are of the pushbutton type or the rotary selector type, and each type of switch is often used in locations where accidental or mistaken alteration of a particular electrical circuit may have serious detrimental consequences.

SUMMARY OF THE INVENTION

In accordance with this invention a turn-push switch operator is provided which comprises a tubular housing, stationary and movable contacts, movable contact operating means including a reciprocable plunger, manual operating means for actuating the plunger to effect opening and closing of the contacts and comprising an actuator and a manual handle, the actuator including a detent and being rotatably and longitudinally movable within the housing, a detent cam operatively connected to the detent, the detent cam being movable longitudinally within the housing and being spring biased against the detent, the cam having a camming surface inclined to the longitudinal axis of the housing, the detent being movable on the camming surface to effect rotation of the actuator, the manual handle being movable rotatably and longitudinally of the detent cam and comprising a projection extending toward the cam, the projection having a detent-engaging surface for moving the detent over the camming surface in one direction thereof, the camming surface having a detent-receiving notch at the end toward which the detent is moved in said one direction by the projection, the actuator and the handle having interfitting key means for enabling simultaneous rotation, the projection having an inclined edge facing the notch, the detent having a portion at the notch end of the camming surface, projection being engageable with the inclined edge when the detent is in the notch to effect rotation of the handle in the other direction when the handle is pushed toward the detent cam, the detent cam comprising a portion extending over and spaced from the notch by a distance sufficient to clear the detent, the cam portion engaging the inclined edge of the projection when the handle is pushed to release the detent from the notch to effect rotation of the handle in response to pressure of the spring bias means on the detent cam, and the detent cam surrounding the actuator and the inclined camming surface thereof being in the path of rotation of the detent.

The advantage of the device of this invention is that the cam operation offers a fast snap action because of a spring which loads the cam against the tube, thus forcing rapid rotation upon pushing the handle.

BRIEF DESCRIPTION OF THE DRAWINGS

FIG. 3 is a horizontal sectional view taken on the line III—III of FIG. 1; and FIG. 4 is a developed view of the detent cam.

DESCRIPTION OF THE PREFERRED EMBODIMENT

Figure 1:
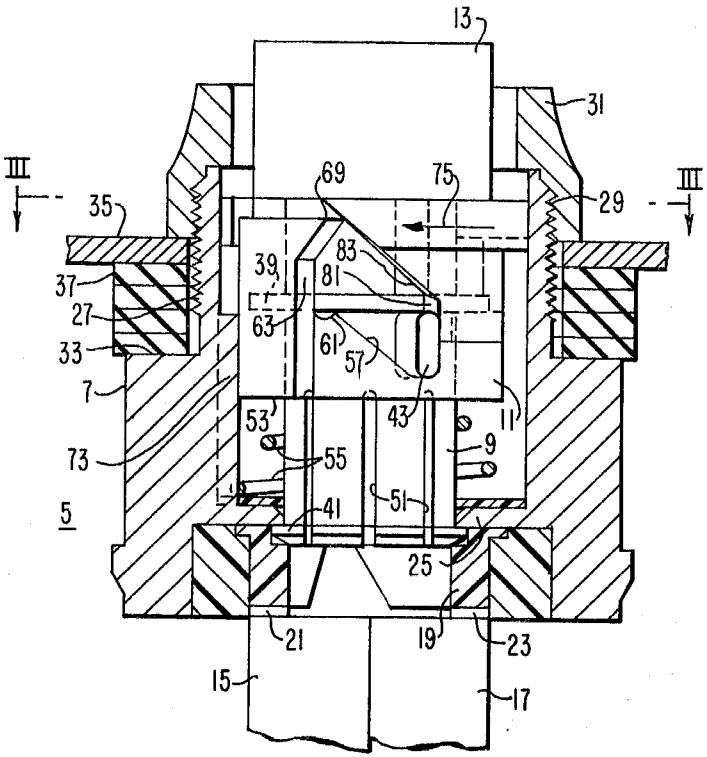
FIG. 1 is a vertical sectional view, partly in elevation, showing the switch structure of this invention.

A switch structure is generally indicated at 5 in FIG. 1 and it comprises a tubular housing 7, an actuator 9, a detent cam 11, and a manual handle 13. The switch structure comprises a number (such as two) of contact blocks or switches 15, 17. An operating cam 19 is attached to the lower end of the actuator 9 for operating plungers 21, 23 of the switches 15, 17, respectively.

The tubular housing 7 comprises an inturned annular flange 25 and has a reduced portion 27 the upper end of which is threaded 29 for retaining a clamp ring 31 in place. Associated with the clamp ring is a shoulder 33 which cooperates with the clamp ring for mounting the switch structure 5 in a hole in a panel 35 with a gasket 37 between the panel and the shoulder 33.

The actuator 9 is a tubular member and is preferably comprised of a dielectric material having upper and lower outturn flanges 39, 41. A pair of diametrically opposite detents 43, 45 extend from the outer surface of the actuator (FIGS. 1, 3) and a pair of keys 47, 49 likewise extend from the outer surface. The lower portion of the actuator 9 includes a plurality of peripherally spaced slots or grooves 51 extending from the lower end upwardly, thereby providng the lower portion of the actuator with a plurality of vertical members from which sections of the lower flange 41 extend under the annular flange 25 for retaining the actuator in place.

The detent cam 11 is an annular member surrounding the actuator 9 and has a lower surface 53 in abutment with biasing means, such as a coil spring 55, the lower end of which is supported on the annular flange 25.

In accordance with this invention the detent cam 11 (FIG. 4) comprises a pair of oppositely disposed camming surfaces 57, the right ends of which terminate at a detent stopping surface 59. Each camming surface 57 is inclined upwardly to the left and terminates with a notch 61 and a detent stopping surface 63 which surface is one edge of a projection 65 of the detent cam 11. Moreover, the upper end of the detent stopping surface 63 extends outwardly at 67 and provides a point 69 which is substantially directly above the notch 61. Finally, the detent cam 11 comprises a pair of diametrically spaced surface notches 71 which engage axially extending similar ribs 73 of the housing 7, whereby the detent cam moves only axially of the switch structure 5.

Figure 2:
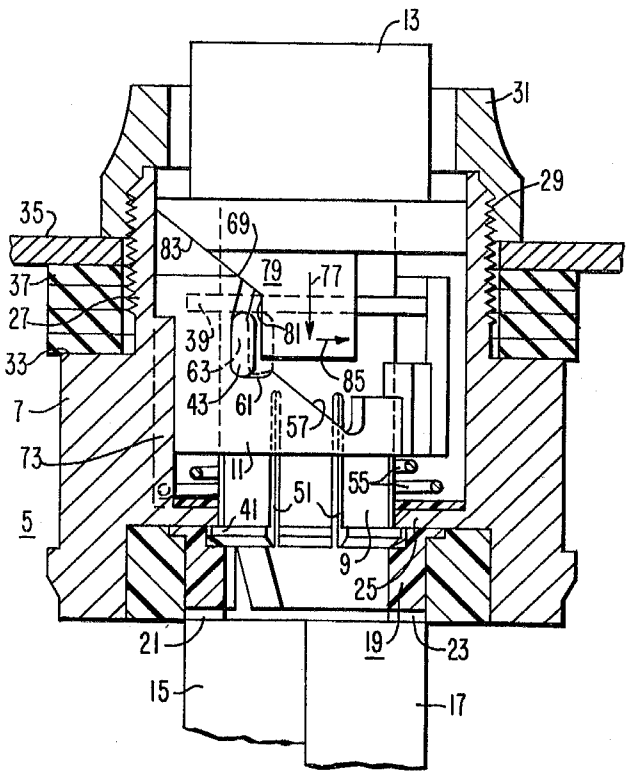
FIG. 2 is a view similar to FIG. 1 showing the switch in an alternate position.

The handle 13 is a tubular member disposed on the upper surface of the flange 39 of the actuator 9 where it is retained by the clamp ring 31. The handle 13 is movable rotatably and axially as indicated by the arrows 75 (FIG. 1) and 77 (FIG. 2). The handle 13 comprises a projection 79 having surfaces 81, 83. The surface 81 operates in abutment with the detent 43 so that upon rotation of the handle 13 in the direction of the arrow 75 the detent moves over the camming surface 57 until it reaches the notch 61 where, without further manipulation of the handle, the detent remains and retains the spring 55 in the compressed condition (FIG. 2). During rotation of the handle 13 from the position of FIG. 1 to that of FIG. 2, the actuator 9 is rotated in the same direction of the handle, thereby rotating the operating cam 19 to actuate the plungers 21, 23 of the switches 15, 17.

The operating cam 19 is attached to the lower end of the actuator 9 with projections extending into the grooves 51 of the actuator at the lower end thereof.

To return the switch actuator to the original position of FIG. 1, and thereby change the conditions of the contacts (not shown) within the switches 15, 17, the handle 13 is pushed in the direction of the arrow 77 (FIG. 2.) Upon pushing the button 13 inwardly (FIG. 2) the inclined surface 83 rides over the point 69, thereby rotating the handle 13 to the right as indicated by the arrow 85. The actuator 9 is likewise rotated simultaneously, because the keys 47, 49 are disposed in keyways 87, 89, respectively. As a result the detents 43 are dislodged from their respective grooves 61 and onto the camming surfaces 57. Upon release of the detents 43 from the notches 61 the spring 55 returns the detent cam 11 to the uppermost position (FIG. 1), thereby facilitating the rotation of the actuator 9 and handle 13 to the original position as shown in FIG. 1.

In conclusion, the push-turn switch operator of this invention provides a device for operating electrical circuits for opening and closing contacts. The device operates by turning to a maintained position then releasing by pushing. It employs a rotatable tubular actuator whose motion is controlled by a cam of a unique structure.

What is claimed is:

1. A turn-push switch operator comprising a tubular housing, stationary and movable contact operating means including a reciprocable plunger, a manual operator, actuator means for actuating the plunger to effect opening and closing of the contacts and comprising an actuator and a manual handle, the actuator including a detent and being rotatably mounted within the housing, a detent cam operatively connected to the detent, the detent cam being movable longitudinally only within the housing and being spring-biased against the detent, the cam having a camming surface inclined to the longitudinal axis of the housing, the detent being movable on the camming surface to effect rotation of the actuation, stop surface means at each end of the camming surface, the manual operator being movable rotatably and longitudinally of the detent cam and comprising a projection extending toward the detent cam, the projection having a detent-engaging surface for moving the detent over the camming surface in one direction thereof, the camming surface having a detent-receiving notch at the end toward which the detent is moved in one direction by the projection, the actuator and the handle having interfitting key means for enabling simultaneous rotation in either direction, the projection having an inclined edge facing the notch, the detent cam having a portion at the notch end of the camming surface, and the portion being engageable with the inclinded edge when the detent is in the notch to effect the rotation of the handle in the other direction when the handle is pushed toward the detent cam.

2. The turn-push switch operator of claim 1 in which the detent cam comprises a cam portion extending over and spaced from the notch by a distance sufficient to clear the detent, and the cam portion engaging the inclined edge of said projection when the handle is pushed to release the detent from the notch to effect rotation of the handle in response to pressure of the spring-bias means on the detent cam.

3. The turn-push switch operator of claim 2 in which the detent extends radially outwardly of the actuator, and the detent cam surrounding the actuator and the inclined camming surface being in the path of rotation of the detent.

4. The turn-push switch operator of claim 3 in which detent moves in a zone perpendicular to the longitudinal axis of the housing.

5. The turn-push switch operator of claim 4 in which an operating cam is operatively mounted on the end of the actuator for actuating the plunger.

* * * * *